United States Patent [19]

Smidt, deceased

[11] Patent Number: 4,738,405

[45] Date of Patent: Apr. 19, 1988

[54] DEVICE FOR DISPENSING ADHESIVE TAPE FROM A SUPPLY ROLLER

[75] Inventor: Joseph J. M. Smidt, deceased, late of TS Leiden, Netherlands, by Maria A. Smidt-Middendorp, heiress

[73] Assignee: Floraco, B.V., Heoreweg, Netherlands

[21] Appl. No.: 916,640

[22] Filed: Oct. 8, 1986

[30] Foreign Application Priority Data

Oct. 9, 1985 [NL] Netherlands ..... 8502751

[51] Int. Cl.[4] ..... B65H 36/07

[52] U.S. Cl. ..... 242/55.2; 156/465; 242/76; 226/196

[58] Field of Search ..... 242/55.2, 76; 226/168, 226/184, 190, 193, 196; 156/465

[56] References Cited

U.S. PATENT DOCUMENTS 2,684,240 7/1954 Lindsey ..... 226/184
3,329,326 7/1967 Simon ..... 226/193

FOREIGN PATENT DOCUMENTS 529515 of 1980 Australia .
2073136 10/1981 United Kingdom ..... 156/465

*Primary Examiner*—John M. Jillions
*Assistant Examiner*—Steven M. Dubois
*Attorney, Agent, or Firm*—Larson and Taylor

[57] ABSTRACT

A device for dispensing adhesive tape (5), provided with a guide roller (8) engaging the agglutinant side of the adhesive tape, which guide roller has a teeth-shaped axial profile, the height (H) of the teeth (14) being at least 0.5 mm and preferably at least 1 mm and the angle ($\alpha$) included by the teeth flanks (15) and a radial plane being not greater than 60° and preferably 45°.

2 Claims, 1 Drawing Sheet

FIG. 1
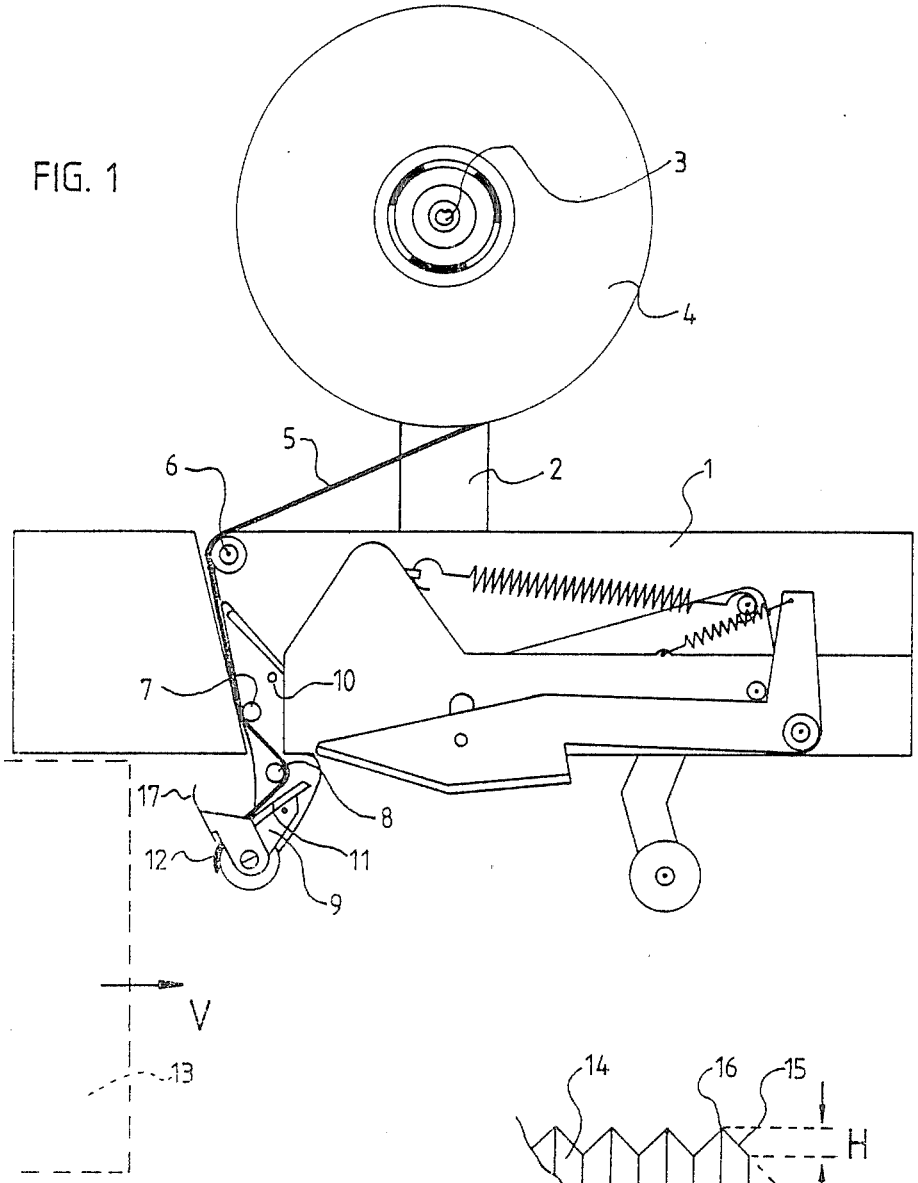
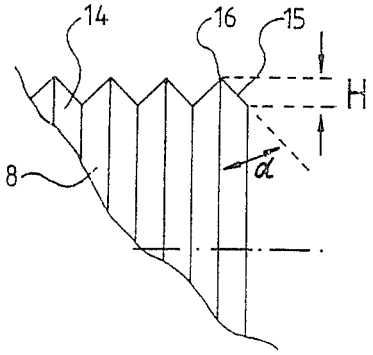
FIG. 2

DEVICE FOR DISPENSING ADHESIVE TAPE FROM A SUPPLY ROLLER

The invention relates to a device for dispensing adhesive tape from a supply roller, which device contains at least one guide roller engaging the side of the adhesive tape which is provided with an agglutinant layer for guiding it along its track.

Such a device has for instance been described in the European Patent Application No. 7900270.1, laid open to public inspection under No. 0 005 888 in name of applicant. With this known device the guide roller engaging the side of the adhesive tape which has been provided with an agglutinant layer presses the last part of the adhesive tape against a plate connected to a pivotable arm. A box folded into the closed position is displaced towards the arm with the adhesive tape retained on the plate such that the adhesive tape is pressed firmly against the front side of the box. With further movement of the box the said arm can pivot and the adhesive tape is pulled over the upper surface of the box, simultaneously with pulling it from the supply roller. Therewith the adhesive tape moves between the guide roller and the plate.

For a long time it is already known that with pulling the adhesive tape between the roller and the plate noise is generated, because the adhesive tape has time and time again to be torn from the guide roller.

Endeavours to overcome this draw back have included adaption of the adhesive tape, for instance by perforating it. This increases the costs of the adhesive tape in a considerable extend, so that such a tape cannot compete, especially because in a device of the depicted type huge quantities of adhesive tape are used. The noise hindrance is then accepted for good measure, though it also has been tried to reduce the noise hindrance by application of a shielding cap over the device. To be effective, such a cap has to extend till far outside the device, because the considered guide roller is located near the part of the device engaging for instance a box to be provided with tape, which has consequently to be rather easily accessible.

Further such a cap leads to difficulties when substituting a full supply roller for an empty one, so that after removal of the cap the possibility exists that this cannot be remounted.

It was found that a considerable reduction of the generated noise can be attained if according to the invention the guide roller, when viewed in axial cross-section, has a toothed surface, that the teeth have a heigt of at least 0.5 mm and that the flanks of the teeth include an angle of not more than 60° with a radial plane passing through the top of the teeth.

It is remarked that a knurled or grooved roller pressing an adhesive tape against a guide roller is known from for instance the Australian Patent Specification No. AU-B-529 515 and the U.S. Pat. No. 2,684,240.

In AU-B-529 515 a grooved pressure roller presses the tape against a guide roller, so that practically only a point contact between the pressure roller and the agglutinant side occurs, which is used in combination with a finger and transverse wire combination to fold the tape longitudinally in order to stably position the tape's end.

U.S. Pat. No. 2,684,240 shows a tape dispenser in which the device for folding the tape longitudinally has a wheel, the circumference of which is provided with a central groove for accommodating the tape when it is longitudinally folded, which wheel is knurled with small axially directed ribs and grooves. The longitudinal folding serves the purpose to stably position the tape's end.

The invention aims to overcome quite another problem. This problem is, as indicated earlier, noise prevention. In none of the above citations this problem is mentioned or solved.

With the invention the adhesive tape engages a great number of very thin spaced tooth edges. Though when pulling the adhesive tape from the guide roller a considerable force has to be exerted no longitudinal tears occur in the adhesive tape.

The height of the teeth should not be too small and the flank angle not too big to prevent that the agglutinant layer of the adhesive tape has a too great contact area with the guide roller.

Preferably the height of the teeth will amount at least 1 mm and the angle included by the flanks of the teeth and a radial plane not more than 45°. Herewith the danger is overcome of sticking of the adhesive tape over a too great area.

The invention in the following is elucidated on hand of an embodiment shown in the drawing, in which:

FIG. 1 shows a side view of a device according to the invention; and

FIG. 2 shows a part of the guide roller according to the invention applied in the device of FIG. 1.

In FIG. 1 only some parts of the inventive device have been shown. The device contains a base plate 1 with a support arm 2 protruding from it, on which a supply roller 4 for adhesive tape 5 can be mounted.

The adhesive tape runs from the supply roller 4 over a guide roller 6, which is rotatably mounted on a fixed location of plate 1. Beyond the roller 6 the adhesive tape runs over a guide roller 7 and from there over the guide roller 8, both these latter rollers being rotatably mounted to an arm 9 only partly shown and in point 10 pivotably mounted to base plate 1. The arm 9 further supports a backing plate 11 against which the last part of the adhesive tape 5 is pressed by the guide roller 8.

The agglutinant side of the adhesive tape 5 and especially the last end 12 of it is directed towards the left as viewed in FIG. 1 and if now for instance a box 13, indicated with interrupted lines, is shifted towards the right side in the direction of the arrow V, the front wall of the box engages the part 12 of the adhesive tape, so that the adhesive tape is sticked on the front wall, whereas with a further shift movement of the box 13 the arm 9 pivots, so that the adhesive tape is further pulled over the upper surface of the box 13 and at the same time pulled from the supply roller 4.

Especially with pulling the adhesive tape 5 over the guide roller 8 much noise is generated and according to the invention this noise can be reduced considerably by shaping the guide roller 8 in the manner shown an an enlarged scale in FIG. 2.

To this end the guide roller 8 possesses teeth 14, which each have a height H which may not be smaller than 0.5 mm, whereas the angle $\alpha$ included by a flank 15 of a tooth 14 with a radial plane passing through the top 16 of the tooth shall not be greater than 60°.

After application of the adhesive tape to the box it is severed by means of a cutting member 17, also pivotably mounted to arm 9.

The working of the device needs no further elucidation, because it corresponds totally with that of the above indicated known device of the published European Patent Application No. 0 005 888.

It is clear that especially in FIG. 2 only a possible embodiment of the guide roller according the invention has been shown and that this can be modified in many ways. Herewith one can consider to space the teeth further from each other by inserting a cylindrical portion between two teeth. All such possibilities, however, will be clear for the man of the art and for a defined type of adhesive tape the optimal dimensions and the number of the teeth to be used can be determined experimentally.

I claim:

1. A device for dispensing adhesive tape from a supply roller, said device comprising at least one guide roller, over which the adhesive tape is pulled, for engaging the side of the adhesive tape which is provided with an agglutinative layer so as to guide the tape along the path of travel therefor, the improvement wherein the guide roller, when viewed in axial cross-section, has a toothed surface, the teeth of said surface having a height of at least 0.5 mm and the flanks of the teeth including an angle of not more than 60° with a radial plane passing through the top of the teeth.

2. A device according to claim 1, wherein the height of the teeth is at least 1 mm and the angle included between the flanks of the teeth and a radial plane passing through the top of the teeth is not greater than 45°.

* * * * *